US007721911B2

(12) United States Patent
Chou

(10) Patent No.: US 7,721,911 B2
(45) Date of Patent: May 25, 2010

(54) ROTATING TYPE CUP LID

(76) Inventor: Bob Chou, 963 N. Fletcher Ave., Valley Stream, NY (US) 11580

( * ) Notice: Subject to any disclaimer, the term of this patent is extended or adjusted under 35 U.S.C. 154(b) by 678 days.

(21) Appl. No.: 11/640,271

(22) Filed: Dec. 18, 2006

(65) Prior Publication Data

US 2008/0142519 A1 Jun. 19, 2008

(51) Int. Cl.
*B65D 51/18* (2006.01)
*B65D 51/16* (2006.01)

(52) U.S. Cl. ..... 220/709; 220/253; 220/256.1; 220/713; 215/310; 215/313

(58) Field of Classification Search ..... 220/253, 220/256.1, 709, 713; 215/310, 313
See application file for complete search history.

(56) References Cited

U.S. PATENT DOCUMENTS 5,484,070 A * 1/1996 Graham ..... 215/223
5,738,236 A * 4/1998 Brun, Jr. ..... 220/253
5,873,475 A * 2/1999 Volpe ..... 215/207
7,159,732 B2 * 1/2007 Smith et al. ..... 220/253
7,318,536 B2 * 1/2008 Maravich et al. ..... 220/780
2004/0140314 A1 * 7/2004 Li ..... 220/709
2006/0283859 A1 * 12/2006 Lu ..... 220/253
2007/0029322 A1 * 2/2007 Durdon et al. ..... 220/254.4

* cited by examiner

*Primary Examiner*—Anthony Stashick
*Assistant Examiner*—Madison L Wright
(74) *Attorney, Agent, or Firm*—Rosenberg, Klein & Lee

(57) ABSTRACT

A rotating type cup lid, includes a cover having a cover portion with a first through hole formed therein, a wall surface disposed around the cover portion, and a flange connecting surface extended from the bottom edge of the wall surface. The rotating type cup lid further includes a rotating body corresponding to the cover portion of the cover. A protruding knob passes through a central circular hole and a downwardly tapered edge is formed at the periphery of the rotating body that is embeddable into an internal surface of the a first latch portion of the cover. The rotating surface of the rotating body includes a second through hole corresponding to the position of the first through hole, a punchable hole with X-shaped break lines, a small opening corresponding to a smaller straw, and a closed surface having no hole, each of which may be rotated into alignment with the first through hole.

2 Claims, 7 Drawing Sheets

ROTATING TYPE CUP LID

BACKGROUND OF THE INVENTION

1. Field of the Invention

The present invention relates to a cup lid structure, and more particularly to a multifunctional cup lid structure that allows users to selectively open and close a drinking opening by rotating the cup lid, and insert a large straw or a small straw.

2. Description of the Related Art

Fast food restaurant, coffee shops, convenience stores and the like, typically distribute beverages in disposable drinking cups. These cups are often provided with drink-through lids having reversible openings, which permit the consumption of liquids contained therein, while at the same time preventing unwanted spillage. Drink-through lids with reversible openings are especially desirable when distributing hot beverages, such as coffee, tea, hot chocolate and the like.

U.S. Pat. No. 4,579,245 to Narushko provides an example of a container lid with a movable closing flap. The lid has a raised segment that forms a channel, which is adapted to receive the closing flap. The closing flap is a curved piece that must be inserted into the channel. The closing flap is movable between an open position and a closed position. Because the movement of the closing flap is controlled by a series of notches, grooves, tabs and handles located on the channel and the closing flap, the closing flap is difficult to operate and the effectiveness of the lid is compromised.

Referring to FIG. 1 for a cup lid 40 disclosed in U.S. Pat. No. 6,612,456 that is issued to Wincup Holdings, Inc., a cover portion 41 of the cup lid 40 includes a recess 42 and a hinged portion 43. If a user wants to drink from the cup, the user can press the hinged portion 43 to break open its front edge to form a hole, and then turn the hinged portion 180° backward to be latched into the recess 42. The method of this patented invention gives a convenient application, but the hinged portion 43 cannot be sealed repeatedly after it is pressed open. If a user has not finished with the drink, the liquid content in the cup may be split out easily when the cup is tilted.

Referring to FIG. 2 for a reclosable container lid 50 as disclosed in U.S. Pat. No. 6,732,875 that is issued to Solo Cup Company, the reclosable container lid 50 includes a cover 51 and a movable second piece 52, wherein the surface of the second piece 52 has a projection 521 exposed from an opening 511 of the cover 51 and a post 522 disposed on another side and exposed from a slot 512; such that the post 522 can be turned and moved to control the opening 511 in an open state or a closed state. However, the operation of turning the post 522 according to the abovementioned method is not easy. The opening 511 can be opened or closed only, but it does not come with other functions.

SUMMARY OF THE INVENTION

It is a primary object of the invention to provide a rotating type cup lid that comprises a cover and a rotating body for latching an internal contact surface. The center of the cover has a circular hole, and the rotating body has a protruding knob for facilitating the operation of driving a rotating body in the cover to reach a predetermined position and achieving the effect of opening or closing the cup lid.

Another objective of the present invention is to provide a rotating type cup lid for the use in different food containers and the operation with a large straw or a small straw according to the requirements of the cup lid, in addition to the function of opening or closing the cup lid.

A further objective of the present invention is to provide a rotating type cup lid that includes a plurality of protruding ribs disposed on a cover and a rotating body to enhance the strength of the cup lid and provides a precise alignment with the position of a through hole of the rotating body.

BRIEF DESCRIPTION OF THE FIGURES

The accomplishment of this and other objects of the invention will become apparent from the following descriptions and its accompanying figures of which.

DETAILED DESCRIPTION OF THE PREFERRED EMBODIMENT

Figure 1:
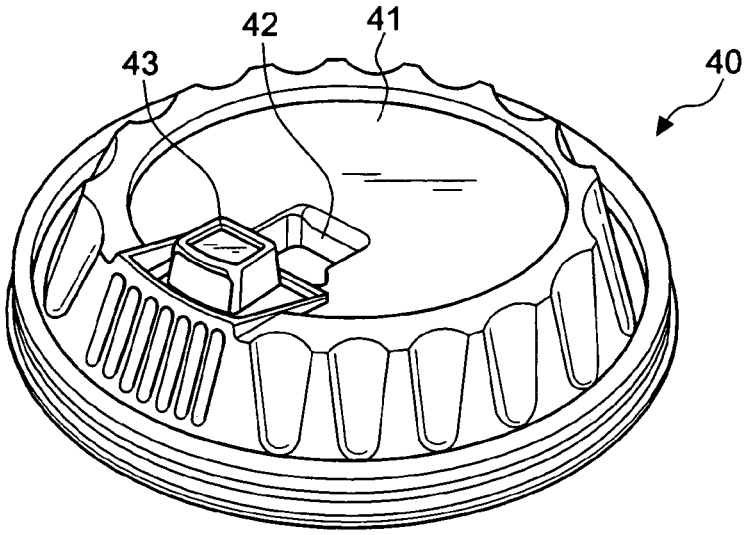
FIG.1 PRIOR ART
FIG. 1 is a schematic view of a cup lid disclosed in U.S. Pat. No. 6,612,456.
Figure 2:
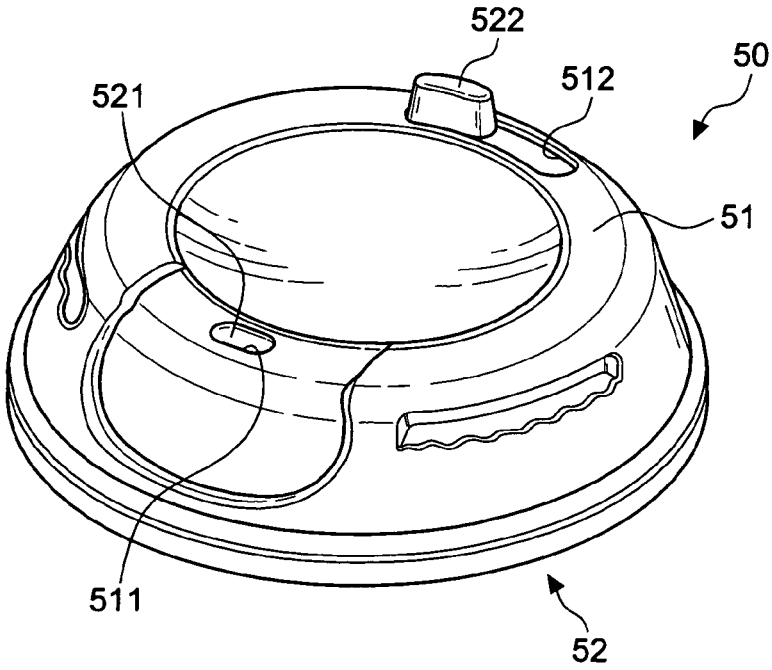
FIG.2 PRIOR ART
FIG. 2 is a schematic view of a cup lid disclosed in U.S. Pat. No. 6,732,875.
Figure 3:
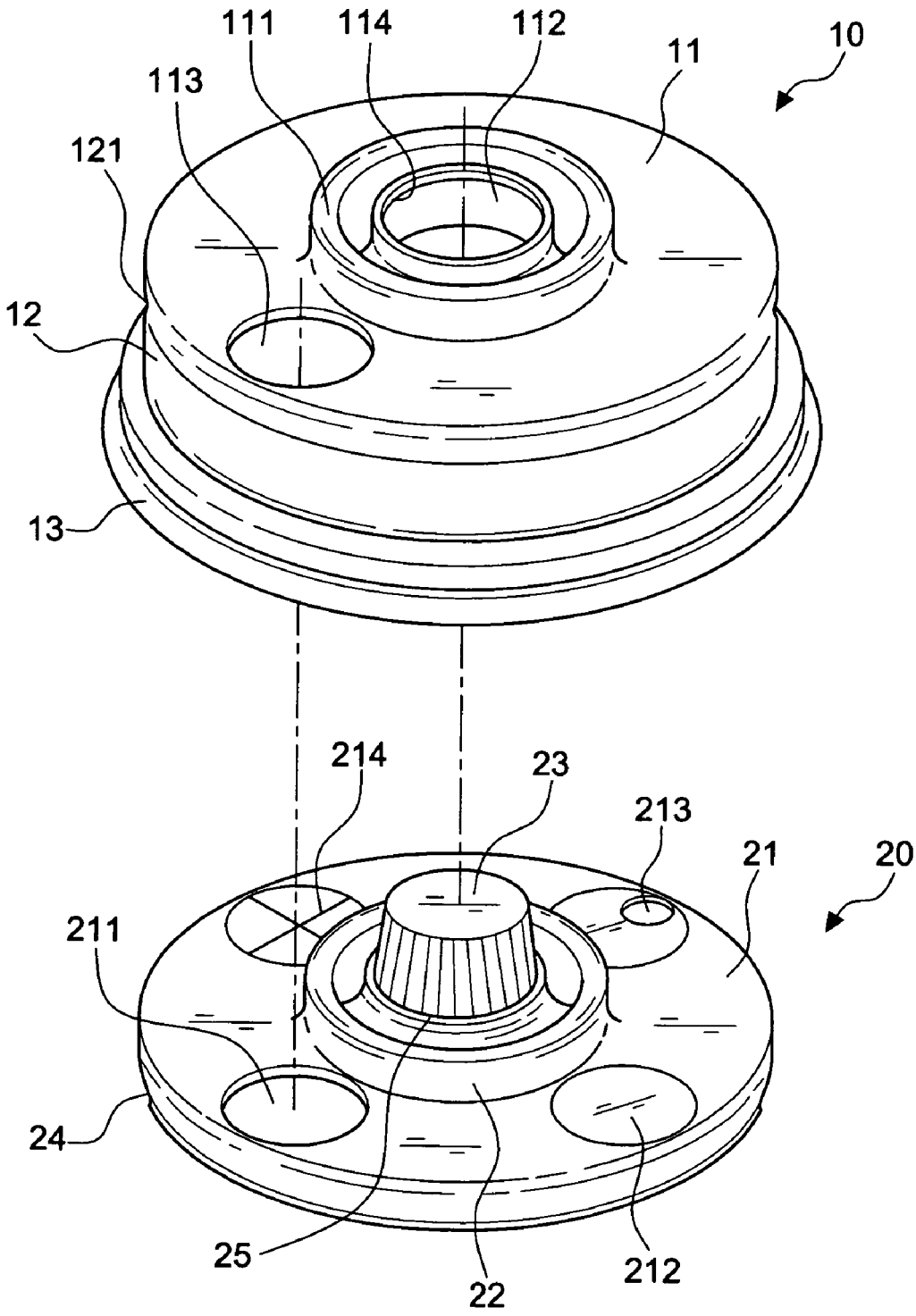
FIG. 3 is an exploded view of a preferred embodiment of the present invention.
Figure 4:
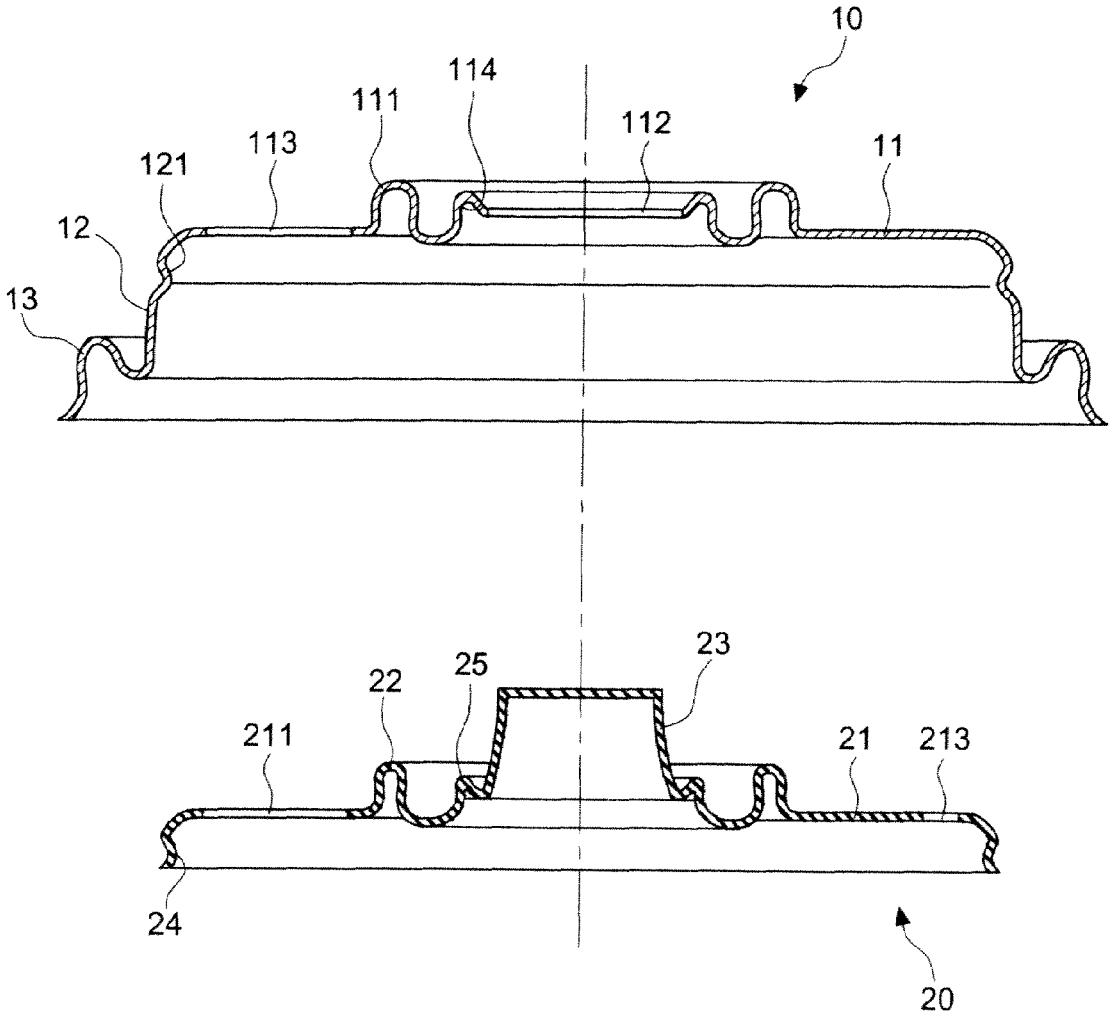
FIG. 4 is a sectional view of a preferred embodiment of the present invention.
Figure 5:
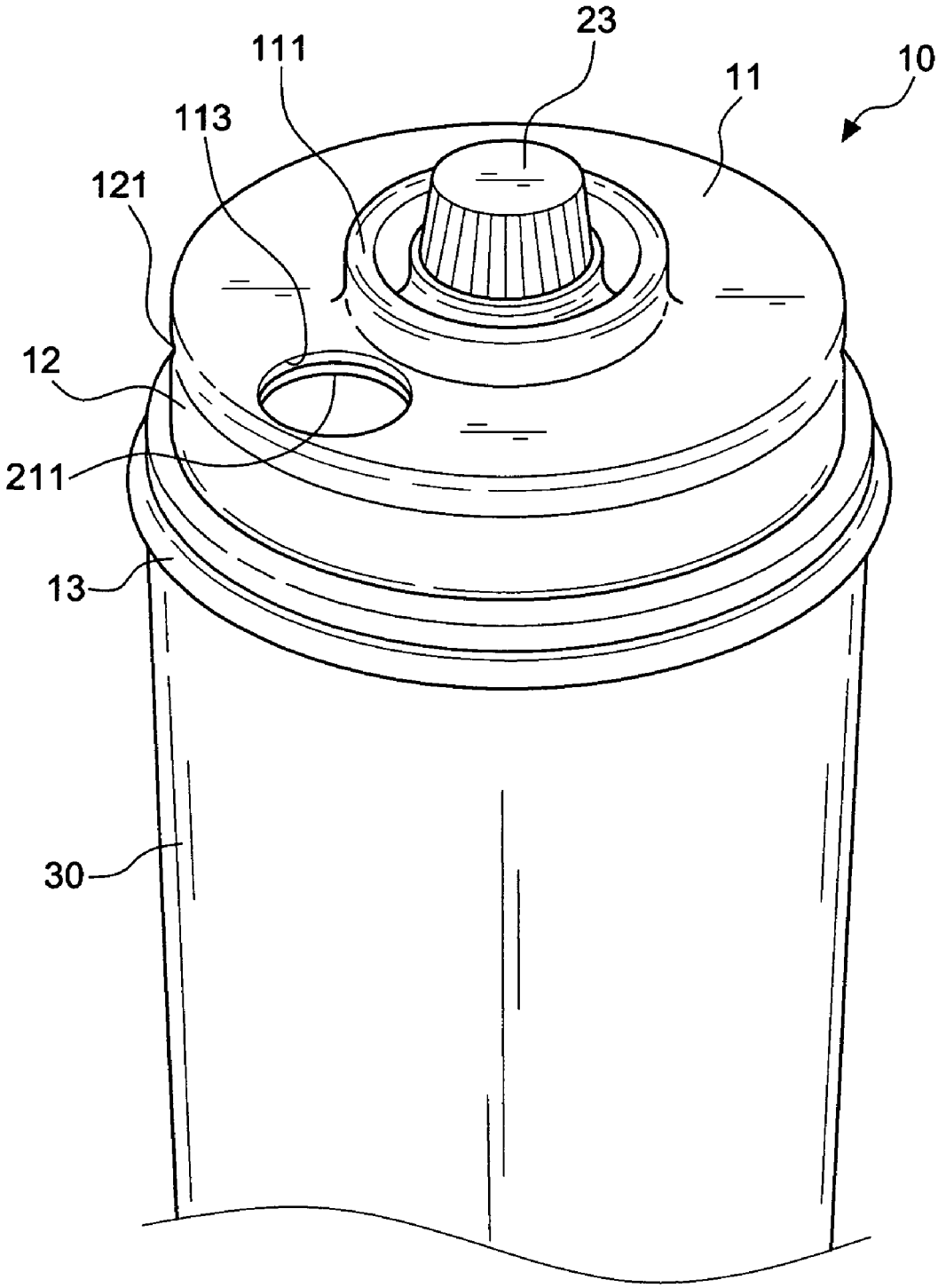
FIG. 5 is a perspective view of a preferred embodiment of the present invention.
Figure 6:
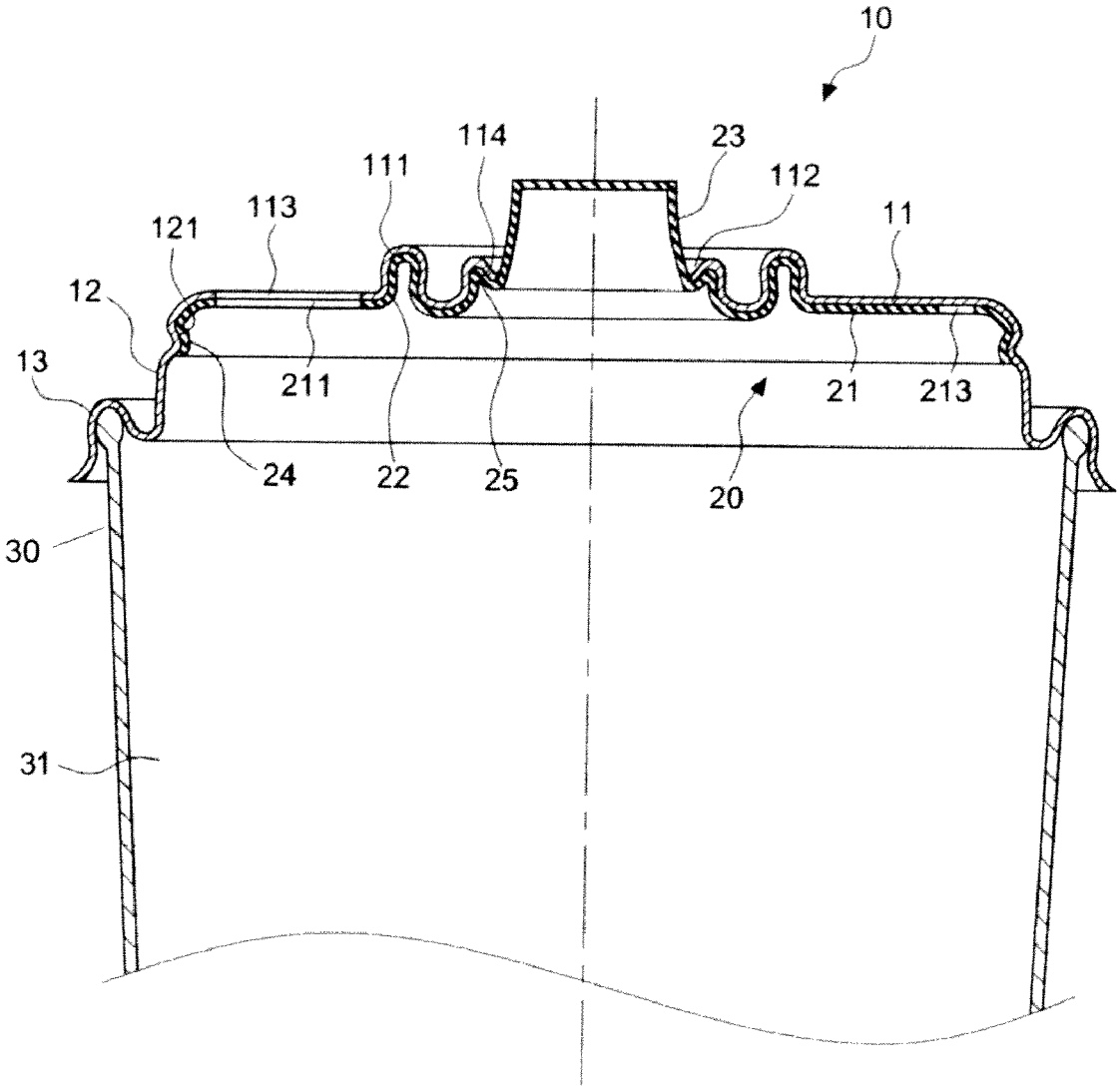
FIG. 6 is a sectional view of a preferred embodiment of the present invention.

Referring to FIGS. 3 to 6, a cup lid structure of a preferred embodiment of the present invention comprises the following elements:

A cover 10 includes a cover portion 11, a wall surface 12 surrounded around the periphery of the cover portion 11, and a flange connecting surface extended from the bottom of the wall surface 12. The connecting surface 13 as shown in FIGS. 5 and 6 is provided for engaging a cup opening 31 of a cup body 30, which is a general conventional structure, and thus will not be described in detail here. The present invention is characterized in that the cover portion 11 has a first circular groove 111 protruded from the center of the cover portion 11, and the first circular groove 111 includes a circular hole 112 on an internal side of the first circular groove 111 and a first through hole 113 on an external side of the first circular groove 111, and the wall surface 12 has an inwardly concave first latch portion 121 disposed at the middle section of the wall surface 12.

A rotating body 20 is installed corresponding to the cover portion 111 of the cover 10, and has a rotating surface 21 corresponding to the cover portion 11, and the rotating surface 21 includes an embeddable second circular groove 22 corresponding to the first circular groove 111, and a protruding knob 23 passing through the central circular hole 112. Further, the periphery of the rotating body 20 forms a downwardly tapered edge 24 on an internal surface of a first latch portion 121 of the cover 10, such that the rotating body 20 can be fixed to an upper half section of the internal edge of the cover 10. When the rotating body 20 is rotated, the rotating surface 21 of the rotating body 20 corresponding to the position of the first through hole 113 includes a second through hole 211 corresponding to the first through hole 113, a puncture hole 214 with X-shaped break lines, a small opening 213 for receiving a corresponding smaller straw, and a closed surface 212 without any hole at all.

With the foregoing structure, the rotating body 20 can be engaged from the bottom of the cover 10 and connected to an internal surface of the cover 10 as shown in FIG. 6. In other words, the rotating body 20 covers the downwardly tapered edge 24 of the rotating body 20 by an elastic clamping force of the first latch portion 121, so that the rotating body 20 will not fall off easily. Of course, the second circular groove 22 can be embedded into the first circular groove 111 to fix the center for a 360° rotation and also provides a partial combining function. Further, the cover 20 includes a downwardly tapered second latch portion 114 disposed at the bottom of an internal circumference of the central circular hole 112, and the rotating body 20 includes a protruding ring 25 disposed at an external periphery of the protruding knob 23 for embedding and positioning the rotating body 20, such that the rotating body 20 can be fixed more securely.

Figure 7:
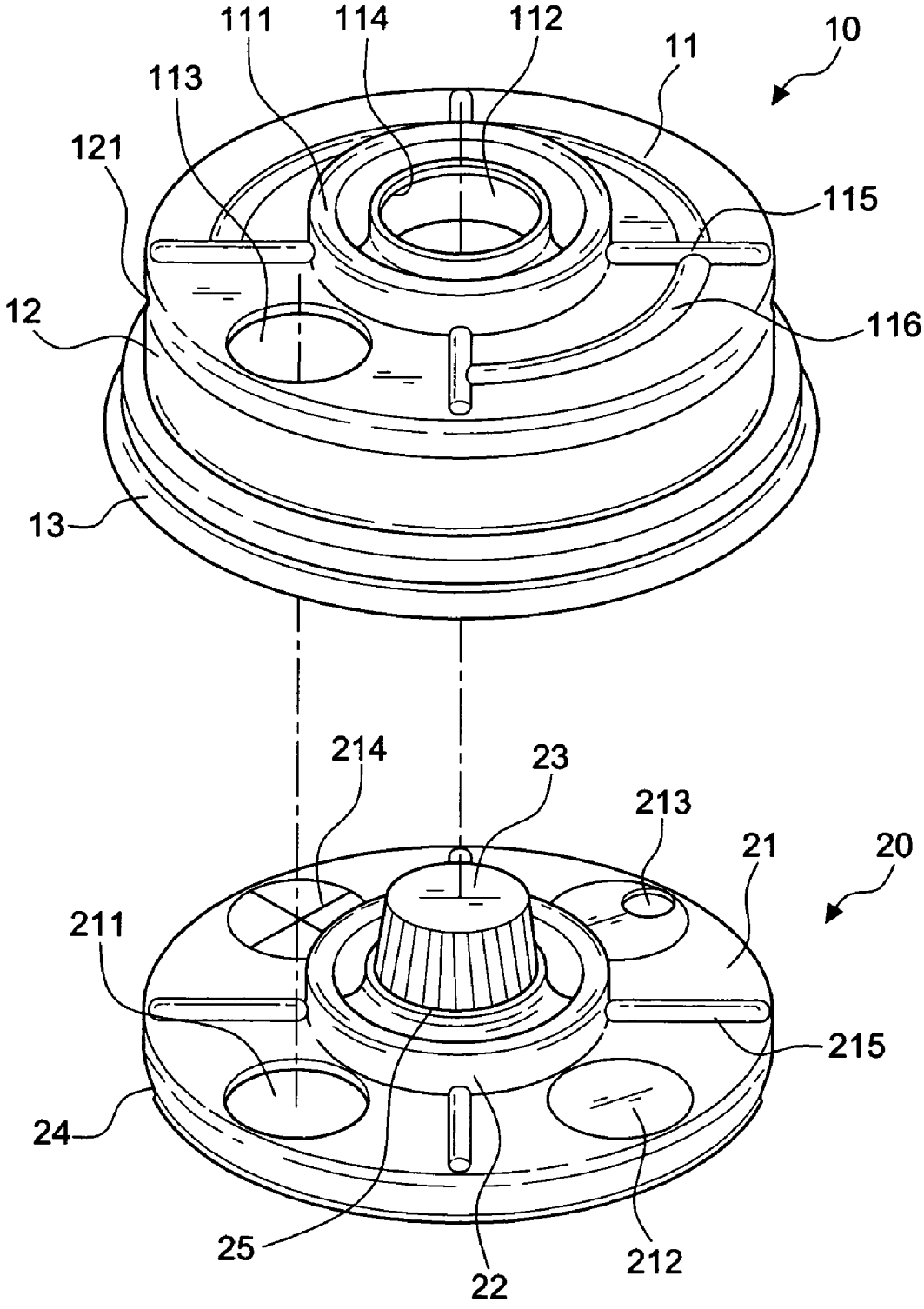
FIG. 7 is an exploded view of another preferred embodiment of the present invention.

Referring to FIG. 7 for a preferred embodiment of the present invention, a cover portion 11 of the cover 10 further includes a plurality of radial first ribs 115 radiating outward from the center of the cover portion 11, and the rotating surface 21 of the rotating body 20 includes a plurality of radial second ribs 215 corresponding to the first ribs 115. If the second rib 215 is rotated to a position corresponding to the bottom of the first rib 115, the first rib 115 is engaged and fixed with the second rib 215. Therefore, the first and second ribs can have a multiple of functions for reinforcing the strength of the cover 10 and the rotating body 20, providing an aligning function, and preventing the rotating surface 21 of the rotating body 20 from being stuck with the cover portion 11. Of course, one or more concentric protruding ribs 116 can be formed between the first ribs 115 of the cover portion 11 for enhancing the strength of the cover portion 11 and preventing a deformation of the cover portion 11 when heated. In addition, the number of first ribs 115 and protruding ribs 116 can be increased as needed.

Figure 8:
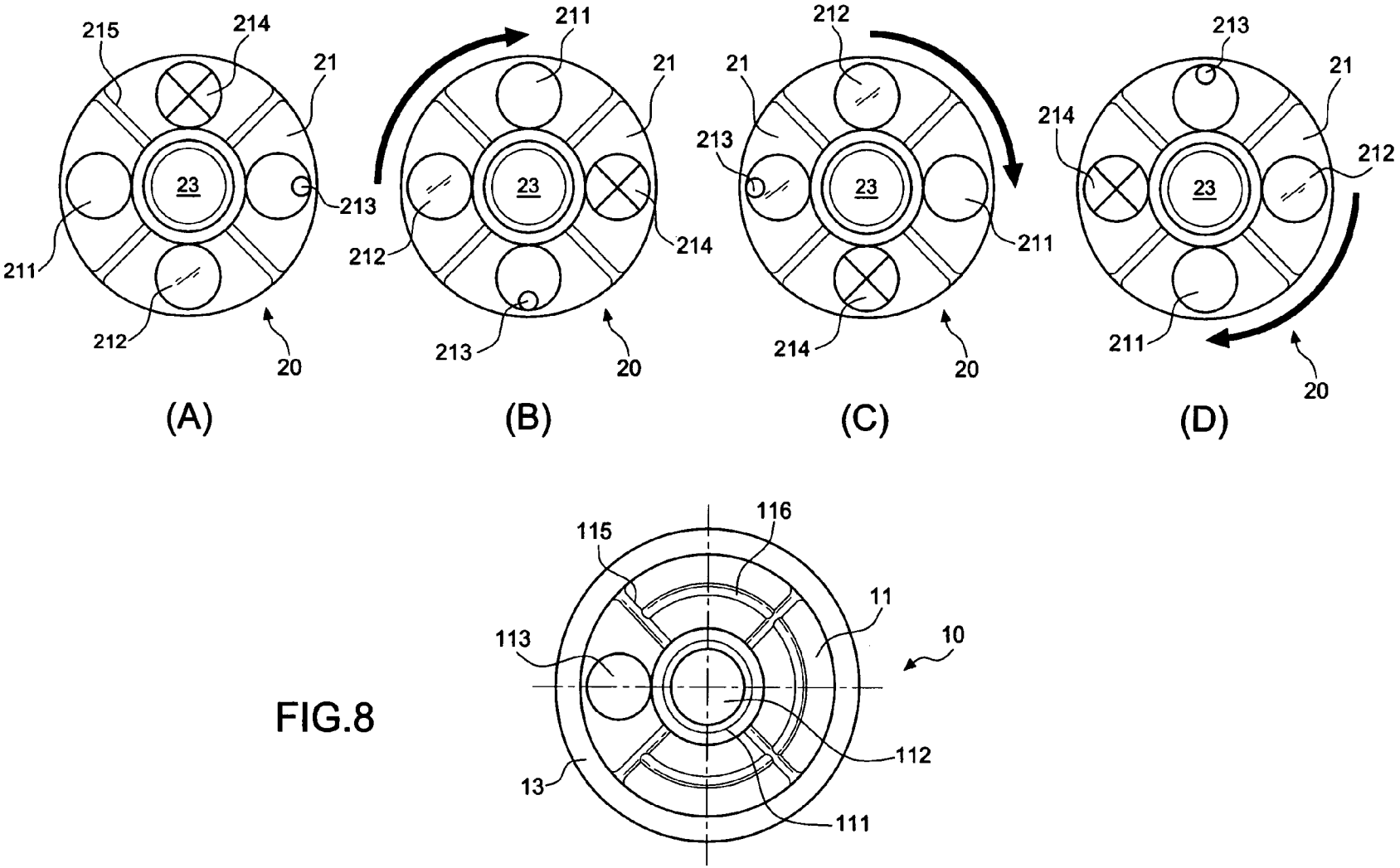
FIG. 8 shows a lid being turned at different angles with respect to a rotating body in accordance with the present invention.

Referring to FIG. 8, the application and effect of the present invention are described as follows:

FIG. 8A shows that the second through hole 211 of the rotating body 20 is aligned precisely with the first through hole 113 of the cover 10, such that when the cup lid is opened, a user can drink a beverage in the cup body 30. If the user needs to close the cup lid after drinking some of the beverage, the user can turn the knob 23 clockwise, and the rotating surface 21 as shown in FIG. 8B changes its angle and rotates the closed surface 212 to a position below the first through hole 113 for closing the first through hole 113, and thus the beverage will not be spilt out easily. FIGS. 8C and 8D are schematic views showing a small opening 213 for receiving an insertion of a small straw and a punchable hole 214 corresponding to the first through hole 113 for receiving an insertion of a larger straw, and thus the present invention allows users to drink the content from the cup body 30 directly by mouth or by straws of different sizes.

Since the large and small openings and the closed surface on the rotating surface 21 of the rotating body 20 can be installed with an appropriate interval apart according to their predetermined positions, so as to position the first and second ribs 115, 215 with an interval apart for precisely turning the rotating surface 21 below the first through hole 113. Furthermore, the protruding knob 23 of the rotating body 20 is positioned precisely at the circular hole 112 at the center of the cover portion 11, and thus the rotation will be smooth and effort-saving, and the present invention can meet user requirements.

Many changes and modifications in the above-described embodiments of the invention can, of course, be carried out without departing from the scope thereof. Accordingly, to promote the progress in science and the useful arts, the invention is disclosed and is intended to be limited only by the scope of the appended claims.

What is claimed is:

1. A rotating type cup lid, mounted on a cup opening of a cup body, for selectively turning open and close the cup opening or providing a use with a large straw or a small straw, and the rotating type cup lid comprising:

a) a cover having a cover portion, a wall surface disposed around of the cover portion, and a flange connecting surface extended from a bottom edge of the wall surface, a center of the cover portion having a protruded first circular groove, an internal side of the first circular groove having a central circular hole and an external side of the first circular groove with a first through hole, a middle section of the wall surface having an inwardly concaved first latch portion, the cover portion of the cover further includes a plurality of first ribs radiating in different paths from a center of the cover portion and at least one concentric circular rib disposed between the first ribs; and b) a rotating body disposed corresponding to a cover portion of the cover and having a second circular groove with a rotating surface corresponding to the rotating surface of the first circular groove, a protruding knob being passed through the central circular hole, a downwardly tapered edge being formed at a periphery of the rotating body that is embeddable into an internal surface of the first latch portion of the cover, such that the rotating body is positioned at an upper half position of an internal edge of the cover, the rotating surface of the rotating body includes a plurality of second ribs radiating in different paths, such that when the second ribs are rotated to be in respective correspondence with the bottom of the first ribs, the second ribs are engaged and positioned thereat;

wherein the rotating surface of the rotating body includes a second through hole formed therein, a punchable hole with X-shaped break lines formed therein, a small opening for receiving a small straw formed therein, and a closed surface having no hole selectively positionable into correspondence with the first through hole responsive to rotation of the rotating body.

2. The rotating type cup lid of claim 1, wherein the cover further includes a second latch portion tapered downwardly and formed at the center of an internal bottom of the circular hole, and the rotating body includes a protruding ring disposed at an external periphery of the protruding knob for embedding and fixing the rotating body.

* * * * *